United States Patent [19]

De La Cruz

[11] Patent Number: 4,936,790

[45] Date of Patent: Jun. 26, 1990

[54] LOW INSERTION FORCE CONNECTOR

[75] Inventor: Mike De La Cruz, Saratoga, Calif.

[73] Assignee: Apple Computer, Inc., Cupertino, Calif.

[21] Appl. No.: 345,763

[22] Filed: Apr. 28, 1989

[51] Int. Cl.[5] ..... H01R 13/15

[52] U.S. Cl. ..... 439/260; 235/482

[58] Field of Search ..... 439/259, 260, 261, 325, 439/326, 489; 235/475, 479, 482, 483, 486

[56] References Cited

U.S. PATENT DOCUMENTS

| | | | |
|---|---|---|---|
| 4,496,213 | 1/1985 | Borsuk | 439/489 X |
| 4,592,608 | 6/1986 | Ohtsuka et al. | 439/261 X |
| 4,724,310 | 2/1988 | Shimamura et al. | 235/483 |
| 4,795,897 | 1/1989 | Chalendard | 235/482 |
| 4,810,203 | 3/1989 | Komatsu | 439/326 |
| 4,839,509 | 6/1989 | Yasuma et al. | 235/482 |

*Primary Examiner*—Neil Abrams
*Assistant Examiner*—Khiem Nguyen
*Attorney, Agent, or Firm*—Blakely, Sokoloff, Taylor & Zafman

[57] ABSTRACT

A connection system for coupling a memory card or other device to a computer system. The connection system utilizes a sliding rack of contacts to provide electrical coupling between the card and the connections system. This sliding rack of contacts is pushed back as a card is inserted and allows the card to be inserted wiht minimal force. The card may then be released by applying a small amount of pressure and then releasing the card. A spring device in the connection system will then force the card out of the connection system to a position where it may be easily removed. The preferred embodiment of the present invention produces an audible and tactile click when the card is properly inserted into the connection system housing. Another audible and tactile click is produced when the card is released. The preferred embodiment also utilizes a flexible circuit for coupling a contact assembly on the sliding rack of connectors to the computer system or other device.

11 Claims, 8 Drawing Sheets

LOW INSERTION FORCE CONNECTOR

BACKGROUND OF THE INVENTION

1. Field of the Invention

This invention relates to the field of connection systems and, more specifically, to the field of connection systems for modular card devices.

2. Prior art.

In the field of connection systems, numerous methods exist for coupling various types of cards or devices to computer systems or to other devices. For example, coupling of printed circuit boards to computer systems is often accomplished using a plated set of connection pads on a tab on the printed circuit board. The tab is inserted into a socket coupled with a computer system. Use of this method typically requires side-to-side movement of the printed circuit board in order to properly seat the printed circuit board in the socket.

Pine and socket connection systems are also well known. These connection systems involve a device having a set of pins which may be coupled with a set of sockets on the computer system or other device. The pin connector on the card is often called the male connector. The socket connector on the computer is often called the female connector. Alternatively, the female conductor may be on the card and the male connector on the computer system. Coupling using the pin and socket connection system poses several problems. First, a large amount of force is generally required to insert the male connector into the female connector. Second, insertion of the male connector into the female connector typically requires side-to-side movement of the card which in turn requires use of several fingers or possible both hands. Third, bending of the pins and wear on the pins and sockets is common.

SUMMARY OF THE INVENTION

The present invention discloses a connection system which allows coupling of a card to a computer system or other device. The present invention utilizes a rack of sliding contacts to ensure ease of insertion of the card into the connection system. The rack of sliding contacts slides backwards as the card is inserted, forcing back a spring device. The rack of sliding contacts is coupled with the card as the rack slides backwards. When the rack reaches its final insertion position an audible and tactile "click" occurs.

To release the card a small amount of pressure is applied to the card. This forces the spring mechanism back slightly into its release position. The spring then releases, forcing the rack of sliding contacts and card forward.

The present invention avoids the prior art problems of bending of pins and wear on the connection system. In addition, the rack of sliding contacts design allows insertion and removal of cards with a very small amount of pressure, such that the cards may be inserted or removed easily with one finger.

The present invention further discloses use of a roller assembly to reduce friction when inserting a card and use of an inertia latch mechanism which reduces the possibility of inadvertent release of the card.

BRIEF DESCRIPTION OF THE DRAWINGS

FIG. 1(*b*) illustrates a prior art socket connector.

FIG. 2(*b*) is a top view of the card which may be inserted into the connection system of the present invention.

FIG. 3(*b*) is a block diagram illustrating the card inserted in the connection system of the present invention.

FIG. 3(*c*) is a block diagram illustrating the card fully inserted in the connection system of the present invention.

FIG. 6(*b*) is a bottom view of the sliding rack of connectors.

FIG. 6(*c*) is a top view of the sliding rack of connectors with a ribbon cable attached.

DETAILED DESCRIPTION OF THE PRESENT INVENTION

A low insertion force connection apparatus is described. In the following description, numerous specific details are set forth such as types of materials, types of cables, etc., in order to provide a thorough understanding of the present invention. It will be obvious, however, to one skilled in the art that the present invention may be practiced without these specific details. In other instances, well-known structures and techniques have not been shown in detail in order not to unnecessarily obscure the present invention.

Figure 1A:
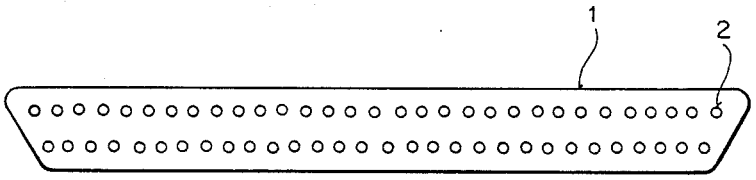
FIG. 1A (PRIOR ART)
FIG. 1(*a*) illustrates a prior art pin connector.
Figure 1B:
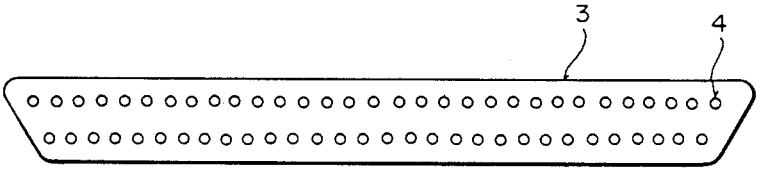
FIG. 1B (PRIOR ART)

FIGS. 1(*a*) and FIG. 1(*b*) are illustrative of one prior art method for coupling cards with computer systems or other devices. FIG. 1(*a*) illustrates a pin connector 1 which may be attached to a card. FIG. 1(*b*) illustrates a socket connector 3 which may be attached to a computer system. The pin connector 1 may be coupled with the socket connector 3 by inserting the pin connector 1 into the socket connector 3. The pins 2 are thereby inserted into the sockets 4. In this manner, the card is electrically coupled to the computer system. This method of coupling cards with computer systems poses several problems.

First, a considerable amount of force is required to insert the pins 2 into the sockets 4. This typically requires use of at least one hand to push the card into the sockets. In the process of coupling the pin connector one with the socket connector 3 a large amount of back and forth movement is typically required. This leads to excessive wear on the pins and sockets and may lead to ending of the pins or the sockets or both. The present invention is designed to overcome these prior art problems and provide a method of inserting a card into a computer system or other device with minimal force and with minimal wear on the connections and chance for breakage or damage to the connection system.

Figure 2A:
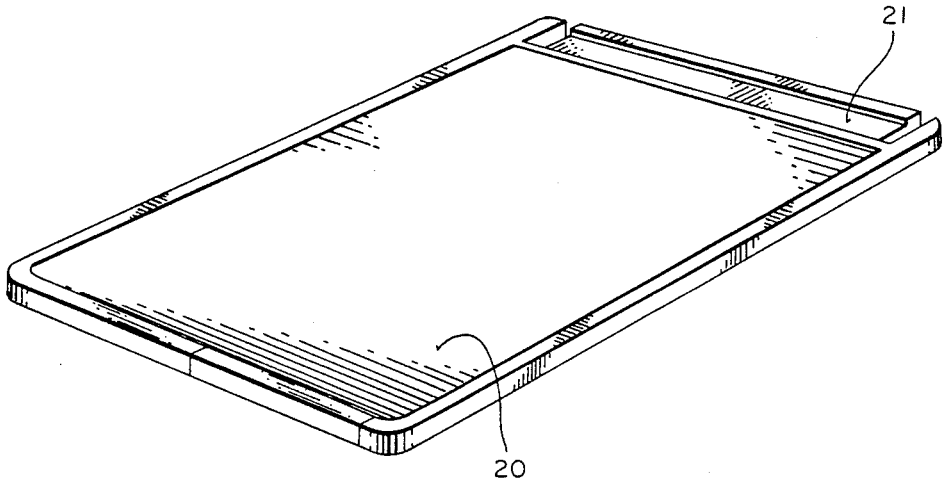
FIG. 2(*a*) is a perspective view of a card which may be inserted into a connection system as disclosed by the present invention.
Figure 2B:
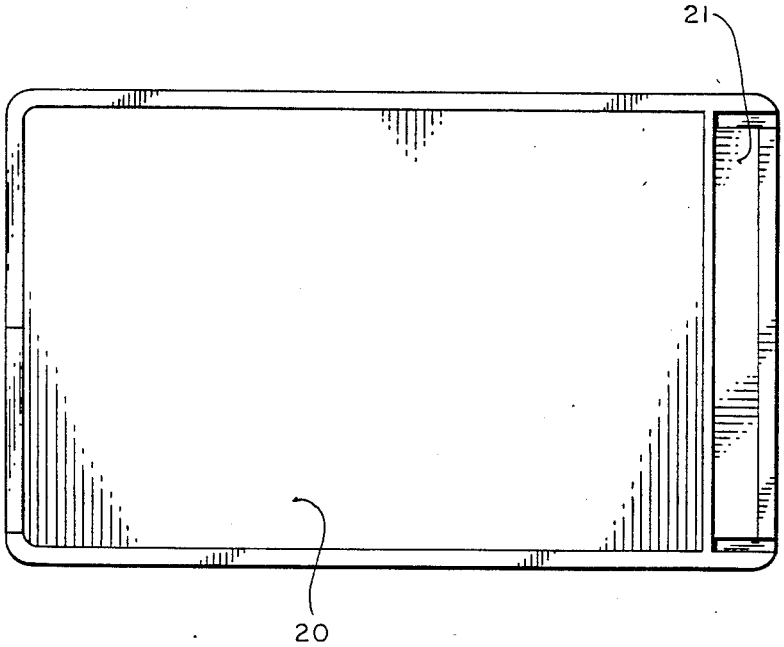

FIGS. 2(*a*) and FIG. 2(*b*) are illustrative of cards which may be inserted into the connection system of the present invention. In the preferred embodiment, these cards 20 may have memory circuitry in the form of either read only memory (ROM) or random access memory (RAM) and may be of various speeds and configurations. It will be obvious to one of ordinary skill in the art that other types of cards may easily be used in the connection system disclosed by the present invention.

The cards 20 of the preferred embodiment have a shutter 21 that closes over the connectors when the card is not inserted into the connection system. It will be seen that the present invention supplies apparatuses for moving the shutter 231 back to expose the connectors when the card is inserted in the connection system housing. It is appreciated that the present invention will work without the shutter 21 and that the shutter is provided in the preferred embodiment for the protection of the connectors.

The cards used in the presently preferred embodiment are more fully disclosed in Applicant's copending applications Ser. No. 039,529 by De La Cruz, et al., filed Apr. 15, 1987 and Ser. No. 048,074 by Mohme, et al., filed May 11, 1987, which are incorporated here by reference.

Figure 3A:
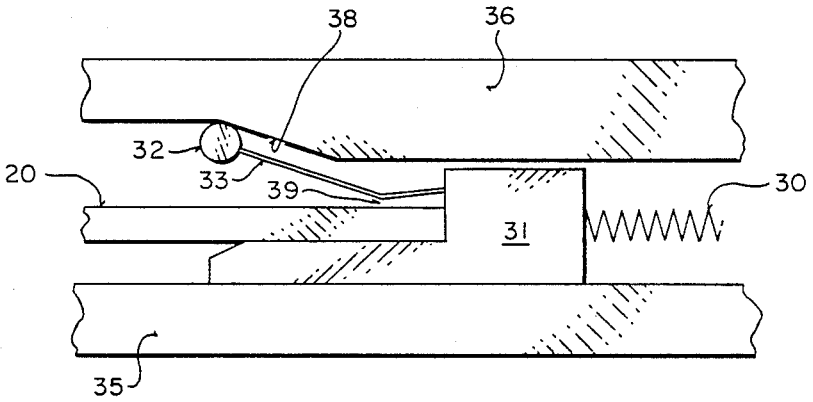
FIG. 3(*a*) is a block diagram illustrating the card being inserted into the connection system of the present invention.
Figure 3B:
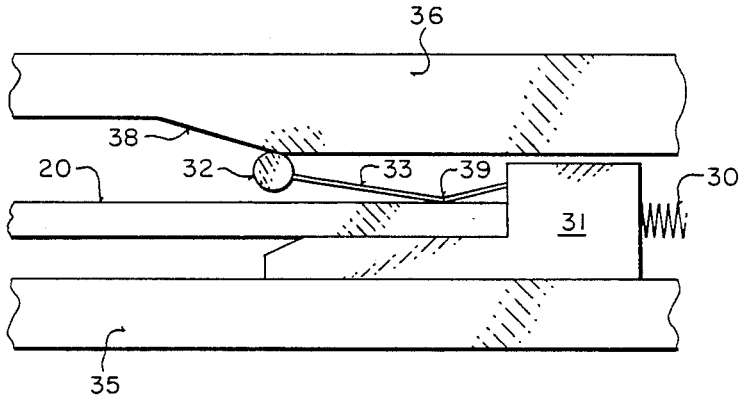
Figure 3C:
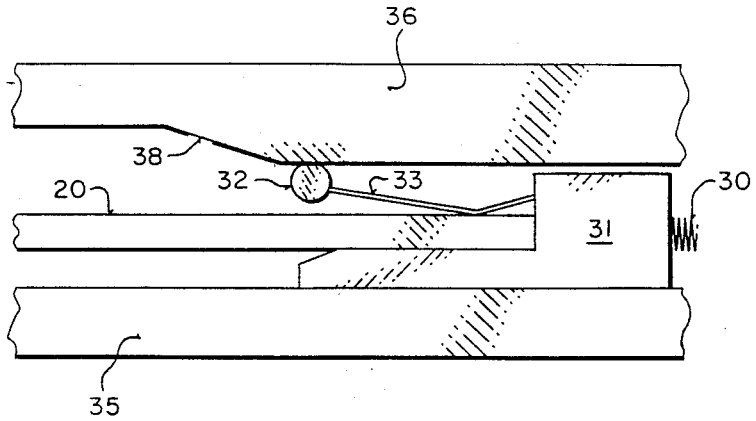

FIGS. 3(*a*), 3(*b*), 3(*c*), 4, 5, 6(*a*), 6(*b*), 6(*c*), 7, 8, 9 and 10 are illustrative of a first embodiment of the present invention. In this embodiment a rack of sliding connectors are employed to electrically couple the card 20 of FIGS. 2(*a*) and 2(*b*) to a computer system.

FIGS. 3(*a*), 3(*b*), 3(*c*) are illustrative of inserting a card into the connection system, the card being seated in its normal inserted position in the connection system, and the card being released from the connection system, respectively. In FIG. 3(*a*), the card 20 is inserted into the connection system housing and rests on the rack of sliding contacts 31. In this position, the contacts 33 are not yet coupled with the card 20 at connection point 39. The rack of sliding contacts 31 sits on the bottom of the connection system housing 35. A contact bar 32 rests along the top of the connection system housing 36. In this position, the spring 30 is uncompressed. It will be seen in connection with FIG. 3(*b*) that as the rack of sliding contacts 31 is pushed back by the card 20 the contact bar 32 slides down the sloped area 398 making contact with the card 20 at connection pint 39.

FIG. 3(*b*) illustrates the card fully inserted into the connection system housing. The rack of sliding contacts 31 has been pushed back forcing the spring 30 into a compressed state. In addition, the contact bar 32 has moved down the sloped area 38 on the top of the connection system housing 36. This forces the contacts 33 to be coupled with the card 20 at connection point 39. As the card 20 is pushed back into the connection system housing the shutter 21, illustrated in FIG. 2, is moved back by two shutter actuators mounted on both sides of the top of the connection system housing 36. These shutter actuators and the shutter are not shown in this figure. Moving back the shutter exposes the connectors on the card 20 as previously discussed in connection with FIGS. 2(*a*) and 2(*b*).

When the card 20 reaches its fully inserted position, shown by FIG. 3(*b*) the spring mechanism produces an audible and tactile click. This lets the user of the connection system know that the card has been properly inserted. This method of inserting the card 20 into the rack of sliding contacts 31 produces minimal wear on the contacts on the card 20 and the on contacts 33 in the sliding rack 31. In addition, insertion of the card into the connection system requires very little force. Typically insertion can be accomplished easily with a single finger.

To release the card from the connection system a small amount of force is applied to the card typically with a single finger. As illustrated in FIG. 3(*c*), this moves the card 20 and the rack of sliding contacts 31 back slightly and further compresses the spring 30. Pushing the card 20 back to the release position causes another audible and tactile click. The spring mechanism then releases, uncompressing the spring 30 and moving the rack of sliding contacts 31 and the card 20 forward. The card 20 may then be easily removed from the connection system housing 40.

Figure 4:
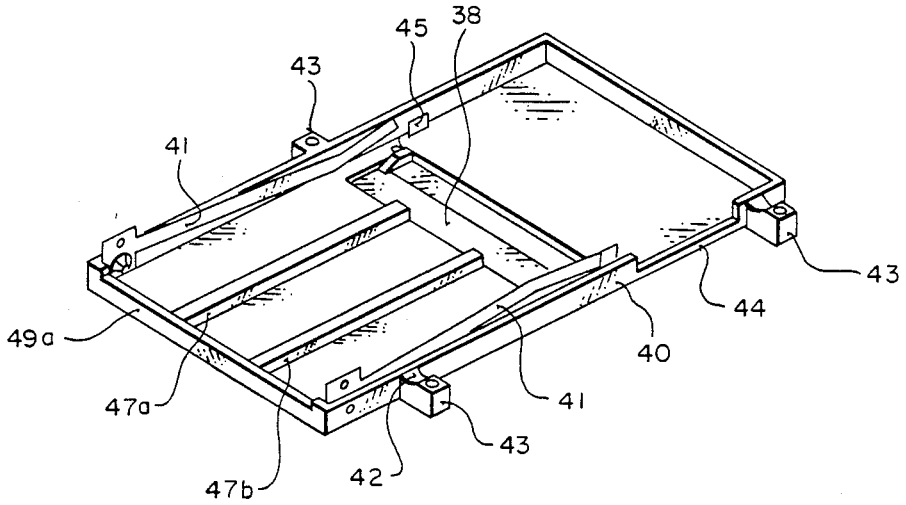
FIG. 4 is a perspective view of the top inside of the connection system housing of the present invention.

FIG. 4 illustrates the top inside of the connection system housing 40 as utilized in the first embodiment of the present invention. The card 20 is inserted into the computer system housing 40 through the slot opening formed by notch 49(*a*) at the front of the computer system housing 40. The card 20 is then guided into place with the guide rails 47(*a*) and 47(*b*) and the leaf springs 41 along the sides of the top of the computer system housing 40. The top of the computer system housing 40 is coupled with the bottom of the computer system housing using the linkage mounts 43. There are two linkage mounts 43 on one side of the computer system housing 40 and one linkage mount 43 on the other side. The two linkage mounts 43 on one side of the computer system housing 40 have rounded notches 42 to hold a locking rod. The lock rod will be more fully described in connection with FIG. 7. The top of the computer system housing 40 also has a notch 44 cut to accommodate the locking mechanism. The locking mechanism will be more fully described in connection with FIGS. 6(*a*), 6(*b*), 6(*c*) and 7. One shutter actuator 45 is illustrated attached to one side of the connection system housing 40. Another shutter actuator (not shown) is attached to the opposite side of the connection system housing 40 near the slot 44 for the locking mechanism. These shutter actuators 45 are used to open the shutter 21 shown in connection with FIGS. 2(*a*) and 2(*b*).

Figure 5:
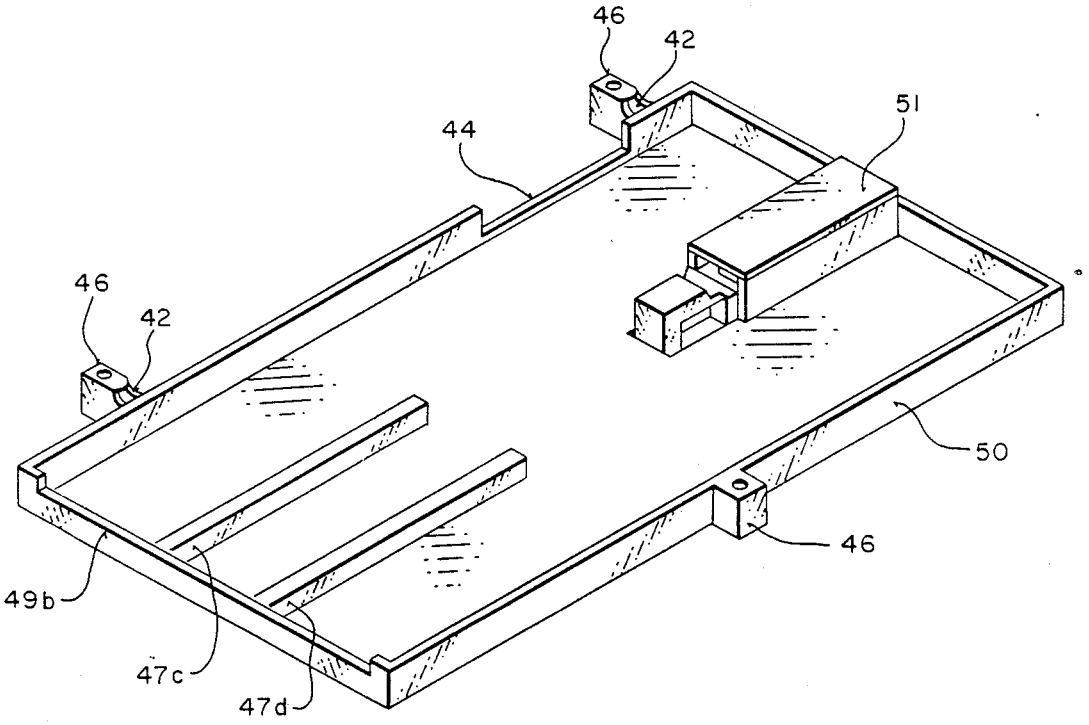
FIG. 5 is a perspective view of the bottom inside of the connection system housing of the present invention.

FIG. 5 is illustrative of the bottom of the connection system housing 50. The bottom of the connection system housing 50 has linkage mounts 46 corresponding with linkage mounts 43 on the top of the connection system housing 40. Two of these linkage mounts 46 also have rounded notches 42 cut to accommodate the locking rod mechanism. A notch 49(*b*) is cut in the front of the bottom of the connection system housing 50 and corresponding with the notch cut in the top of the connection system housing 40 to allow the card to be inserted. Another notch 44 is cut in the side of the bottom of the connection system housing 50 to accommodate the locking mechanism and corresponds with the notch cut in the top of the connection system housing 40. Guide rails 47(*c*) and 47(*d*) are provided to assist with alignment of the card as it is being inserted. The bottom of the connection system housing 50 contains the spring assembly 51, the function of which was described in connection with FIGS. 3(*a*), 3(*b*) and 3(*c*). The components of the spring assembly 51 will be more fully described in connection with FIG. 8. Both FIG. 4 and FIG. 5 illustrates the connection system housing without the rack of sliding contacts. The rack of sliding contacts will be more fully described in connection with FIGS. 6(*a*), 6(*b*) and 6(*c*).

Figure 6A:
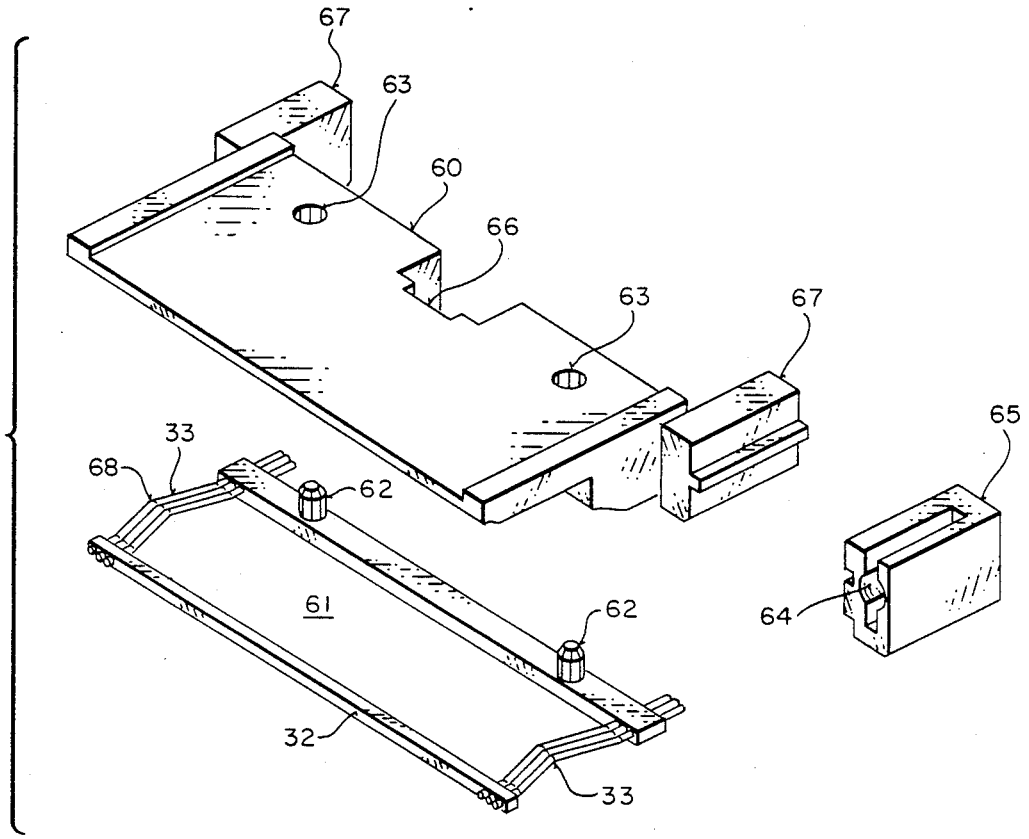
FIG. 6(*a*) is an explosion view of a sliding rack of connectors as utilized by the present invention.
Figure 6B:
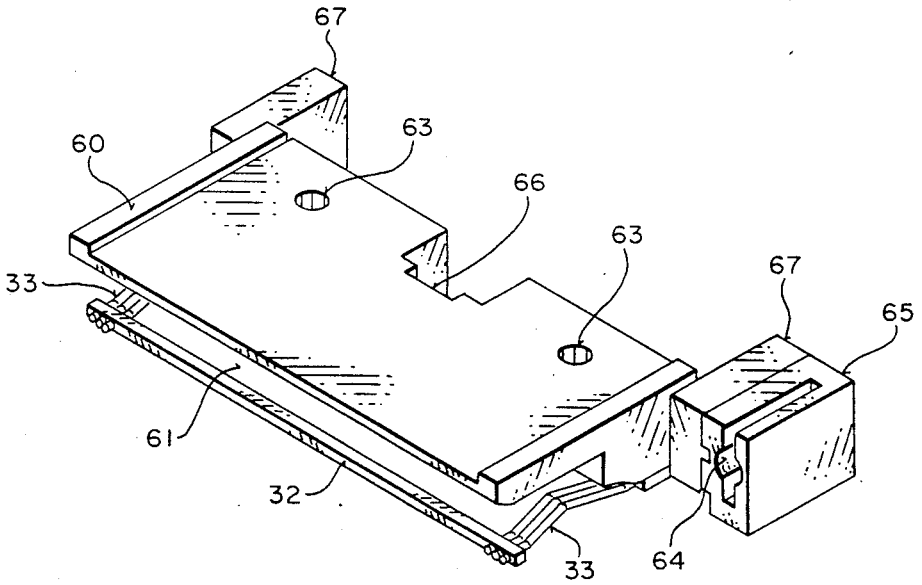
Figure 6C:
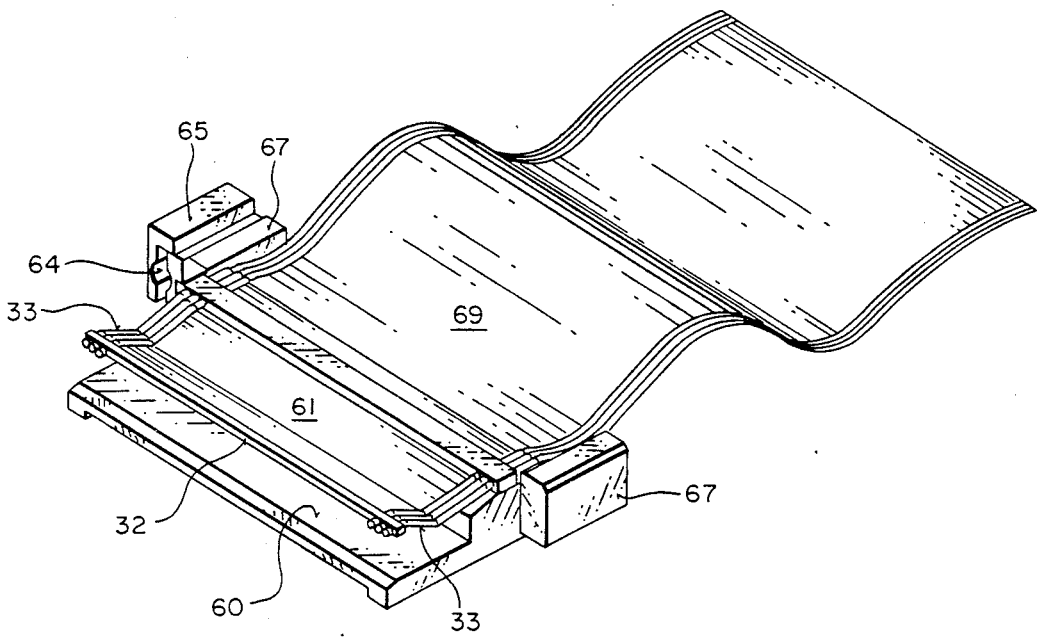

FIG. 6(*a*) is a bottom side explosion view of the rack of sliding contacts. The sliding rack 60 has post holes 63 for coupling with the contact assembly 61. The contact assembly 61 has posts 62 which are inserted into the post holes 63 when the rack of sliding contacts is assembled. The sliding rack 60 also has a notch 66 cut to accommodate the spring assembly shown in FIG. 5 and has side mounts 67. Coupled with one of the side mounts 67 is a holder 65 for holding the locking rod. This holder 65 embodies a hole 64 for holding the rod.

The contact assembly 61 comprises the contact bar more fully described in connection with FIGS. 3(*a*), 3(*b*) and 3(*c*), contacts 33 and the post 62. The contacts 33 have a bend 68 for coupling with the contacts on the card. The posts 62 are inserted into the post holes 63 of the sliding rack 60.

FIG. 6(*b*) illustrates the sliding rack assembly with the contact assembly 61 and the rod holder 65 coupled with it. After the contact assembly 61 is coupled with the sliding rack 60 by inserting the posts on the contact assembly 61 into the post holds 63, the post holes are filled with epoxy.

FIG. 6(*c*) illustrates the top side of the assembled contact assembly 61 and sliding rack 60. A flexible circuit 69 is coupled with the contacts 33 on the contact assembly 61. The flexible circuit 69 is used for coupling with the computer system or other device. An alternative is the use of ribbon cable in place of the flexible circuit 69.

Figure 7:
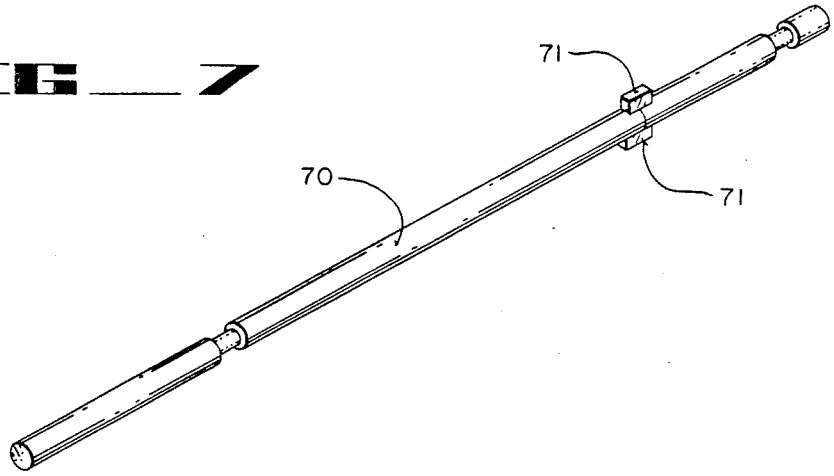
FIG. 7 is a perspective view of a locking mechanism as utilized by the present invention.

FIG. 7 illustrates a locking rod 70 as may be utilized by the present invention. The locking rod 70 is held in place as previously described in connection with FIGS. 4 and 5 by the slots in the linkage mounts on the top and bottom of the connection system housing. The locking rod 70 goes through the hole in the rod holder as described in conjunction with FIGS. 6(*a*) and 6(*b*). The tabs 71 on the rod 70 allow the sliding rack to move back and forth freely when the rod 70 is turned in one position by passing back and forth in a slot cut for them in the rod holder. When the rod 70 is turned 90° the tabs 71 will not align with the slots cut for them and will hold the sliding rack in its inserted position.

Figure 8:
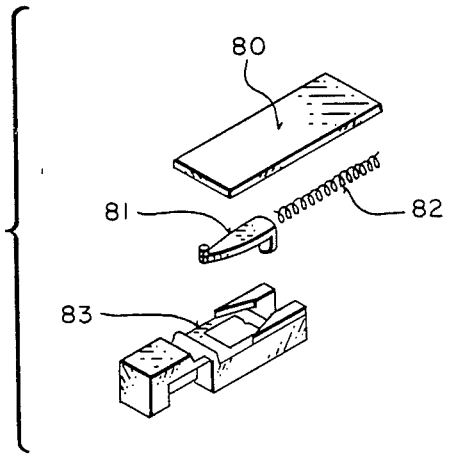
FIG. 8 is an explosion view of a spring assembly as utilized by the present invention.

FIG. 8 further illustrates the spring assembly utilized in the present invention. As previously described in connection with FIG. 6(*a*) the spring pusher apparatus 83 coupled with the sliding rack in the notch provided therein. The cam holder 81 couples with the pusher and the spring 82. The cover 80 is then placed over the top of the spring assembly when the spring assembly is assembled in the bottom of the connection housing.

Figure 9:
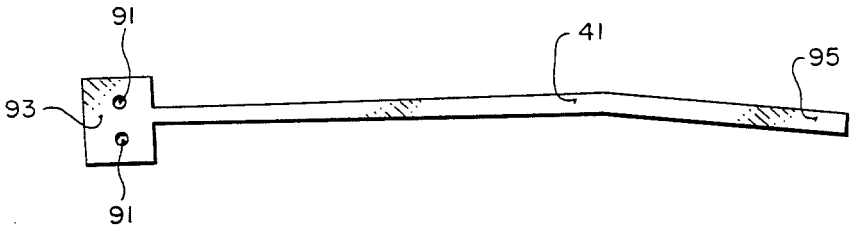
FIG. 9 is a side view of a leaf spring as utilized by the present invention.

FIG. 9 illustrates a leaf spring 41 which is used to guide the card into the connection housing assembly and to minimize back and forth movement when the card is in its fully inserted position. The leaf spring 41 comprises a strip of metal 95 which is wide at one end 93. The wide end 93 embodies two screw holes 91. The screw holes 91 are for coupling with the connection system housing.

Figure 10:
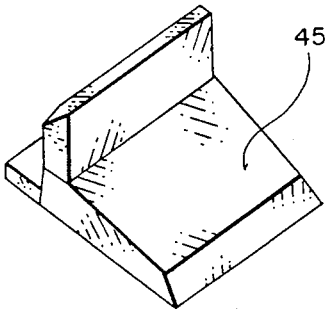
FIG. 10 is a perspective view of a shutter actuator as utilized by the present invention.

FIG. 10 illustrates a shutter actuator 45 for causing the shutter on the card to open as it is inserted into the connection system housing. Two shutter actuators 45 are coupled with the top of the connection system housing as was illustrated in connection with FIG. 4.

Figure 11:
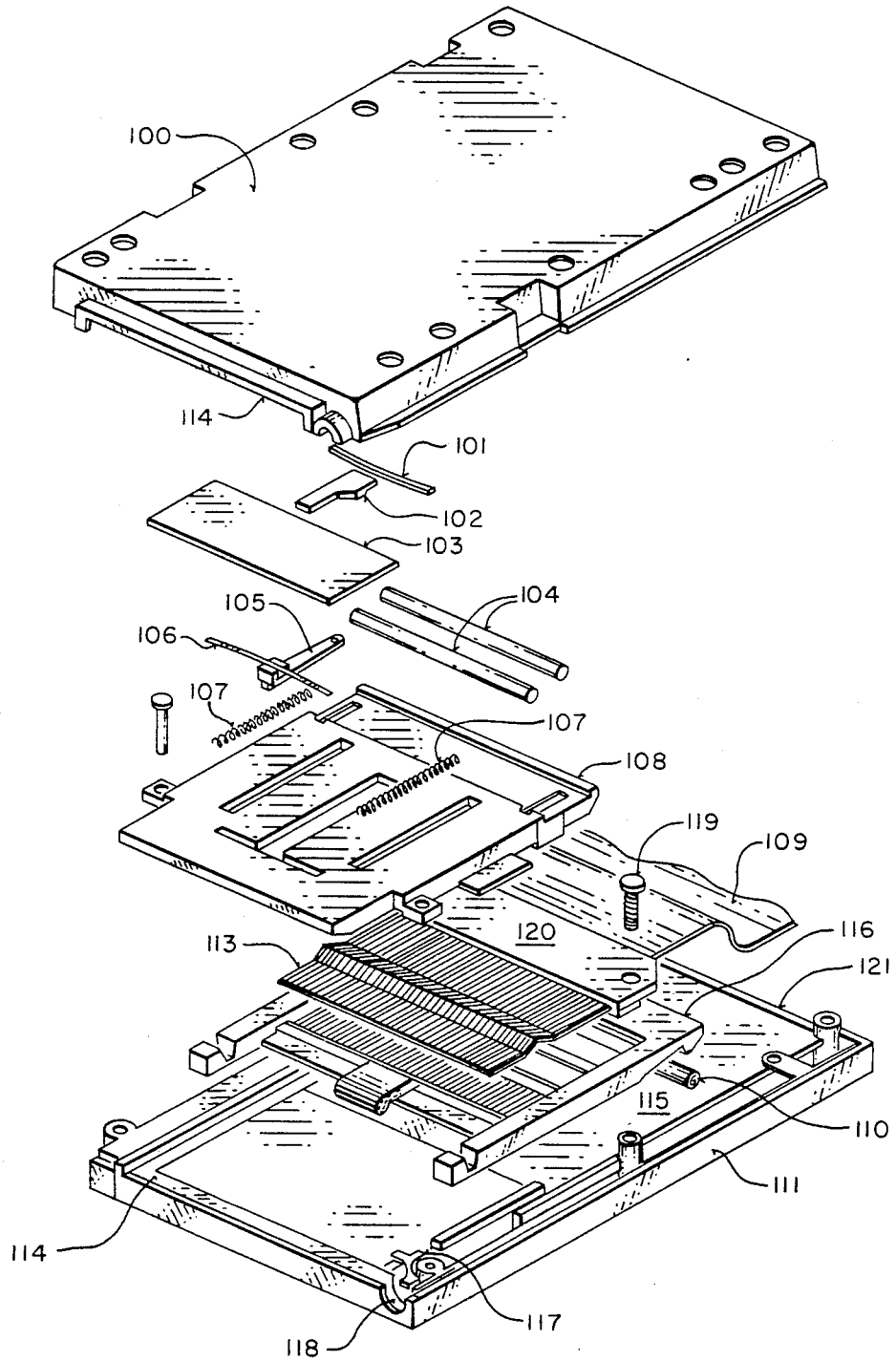
FIG. 11 is an explosion view of a second embodiment of the present invention.

FIG. 11 is an explosion view of a second embodiment of the present invention. This embodiment illustrates several inventive advantages over the first embodiment and is currently the preferred embodiment of the present invention.

As illustrated by FIG. 11, the second embodiment comprises an uppercase cover 100 and a lowercase cover 111. Once a low insertion force connector is assembled, it may be stacked with other low insertion force connectors in a single assembly. The second embodiment utilizes a plurality of rollers 104 and 110 which reduces sliding friction encountered in the first embodiment. The rolling friction encountered in this embodiment has been shown to have an approximately 20:1 advantage over the sliding friction of the first embodiment. Further, the rollers 104 and 110 concentrate the contact load forces on the edge of the case and thereby minimize the case deflections, as the steel rollers carry the loads rather than the plastic case. Further, rolling the contacts 113, instead of sliding the contacts, when engaging with the slim card eliminates build up of stresses in the contacts 113 during initial non-engaged travel and reduces frictional abrasion on the slim card.

The slim card is normally inserted into the connector through slot 114 where it engages shutter retracting teeth (not shown) so that the shutter is fully retracted when the card contacts the rear of upper carriage assembly 108. The slim card contacting with the carriage assembly moves the carriage assembly to the rear of the case. As this happens, the lower carriage assembly 116 begins to move upward on ramp 115 until the contacts 113 are fully engaged with the slim card. After the contacts 113 are fully engaged with the slim card, the ramp 115 flattens out in order to allow the carriage assembly to travel directly to the rear of the case approximately 0.050 inches which allows a pawl 105 in an audible latch mechanism to move into an engaged position without over stressing the contacts 113. When finger pressure is removed from the slim card, the slim card and carriage assembly move forward approximately 0.045 inches, being driven by eject springs 107 until the pawl 105 contacts a latching island (not shown) in the uppercase. The next time finger pressure is applied to move the card toward the rear of the case, the pawl 105 moves past the latching island and removal of the finger pressure allows the eject springs 107 to eject the card.

In order to prevent a sudden shock such as dropping the case or hitting the case with another object from simulating finger pressure and release the card, in a inertial latch mechanism employed. The inertial latch mechanism comprises an inertia latch spring 101, inertia latch 102, inertia latch weight 103, and a second inertia latch spring 106 coupled with the pawl 105. The inertial latch mechanism is coupled with the latching island. When a sudden shock occurs, the weight 103 forces the pawl 105 temporarily toward the rear of the case. This prevents the pawl 105 from moving to its unlatched position. The springs 101 and 106 allow the pawl 105 to return to its latched position at a slower rate then springs 107 return the carriage. Thus, the next application of thumb pressure will unlatch the pawl 105 and eject the card.

A locking feature 117 is provided on the front corner of the case 111. The locking feature 117 comprises a spring loaded device which engages a notch on the side of the slim card. The notch may be optionally provided on cards where casual disengagement of the card is not desired. For example, such a notch may be provided on a ROM slim card. Unlocking of cards with such a notch is accomplished by inserting a pin or other device such as a paper clip into an access hole 118. A force of approximately 1.7 pounds will deflect the spring on the locking mechanism 117 enough to disengage the card from it at which point finger pressure on the front of the card will disengage the card in the manner previously described.

Connection between the contacts 113 and a computer system is provided by a flex circuit 109 which is soldered terminated to the contacts 113. The flex circuit is strain relieved by screws 119 which hold a contact header 120 to the lower carriage assembly 116. The flex circuit 109 is also strain relieved where it exits the case at point 121. The length of the flex circuit between these strain relieves is longer than the distant between them in the disengaged position of the carriage assembly. This forces the flex circuit into a gentle s-bend. Moving the carriage toward the rear of the case during insertion of the card deepens this s-bend which distributes the bending stresses evenly along the enclosed length of the flex circuit.

Thus, a connection system for coupling a memory card or other device to a computer system or other device with minimal insertion force is described.

What is claimed is:

1. A connection apparatus comprising:

housing means defining an opening for housing a first device;

first coupling means coupled with said housing means for providing electrical coupling with said first device, said first coupling means comprising a plurality of contacts, said plurality of contacts with a connector bar;

second coupling means coupled with a second device;

a sliding rack coupled with said first coupling means and said second coupling means, said sliding rack sliding back into said housing means as said first device is inserted into said housing means with a first pressure.

2. The connection apparatus, as recited in claim 1, wherein said housing means comprises a top apparatus and a bottom apparatus, said top apparatus being coupled with said bottom apparatus.

3. The connection apparatus, as recited in claim 1, wherein said plurality of contacts are bent for providing coupling with said first device.

4. The connection apparatus, as recited by claim 3, wherein said bottom apparatus comprises a first locking means for providing an audible and tactile sound when said first device is fully inserted into said housing means.

5. The connection apparatus, as recited in claim 4, wherein said first locking means provides an audible and tactile sound when said first device is released from said housing means.

6. The connection apparatus, as recited in claim 1, wherein said second coupling means comprises a flexible circuit.

7. The connection apparatus, as recited in claim 1, wherein said first device comprises:

a circuit;

a second housing means coupled with said circuit;

a second plurality of contacts coupled with said circuit.

8. The connection apparatus, as recited in claim 7, wherein said first device further comprises a shutter apparatus coupled with said second housing means for providing protection for said circuit.

9. A connection apparatus for coupling a circuit with a computer system comprising:

a housing defining an opening;

a sliding rack coupled with said housing means;

a plurality of first contacts coupled with said sliding rack for providing electrical coupling between said plurality of first contacts and said circuit, said plurality of contacts coupled together with a connector;

a coupling means coupled with said plurality of contacts for providing electrical coupling between said plurality of said first contacts and said computer system;

said sliding rack being capable of sliding back into said housing means when said circuit is inserted into said housing means for providing easier insertion of said circuit into said housing means;

a first locking means coupled with said sliding rack for holding said sliding rack in place when said circuit is inserted.

10. The connection apparatus, as recited in claim 9, wherein said coupling means comprises a flexible circuit.

11. The connection apparatus, as recited by claim 10, further comprising:

shutter means coupled with said circuit for protecting said circuit;

shutter opener means coupled with said housing for opening said shutter means as said circuit is inserted into said housing.

* * * * *